US009885542B2

(12) United States Patent
Lasco

(10) Patent No.: US 9,885,542 B2
(45) Date of Patent: Feb. 6, 2018

(54) WEAPON SIGHT

(71) Applicant: Aaron G. Lasco, Belgrade, MT (US)

(72) Inventor: Aaron G. Lasco, Belgrade, MT (US)

( * ) Notice: Subject to any disclaimer, the term of this patent is extended or adjusted under 35 U.S.C. 154(b) by 0 days.

(21) Appl. No.: 15/066,565

(22) Filed: Mar. 10, 2016

(65) Prior Publication Data

US 2017/0261289 A1 Sep. 14, 2017

(51) Int. Cl.
*F41G 1/467* (2006.01)
*F41G 3/08* (2006.01)

(52) U.S. Cl.
CPC ..... *F41G 1/467* (2013.01); *F41G 3/08* (2013.01)

(58) Field of Classification Search
CPC . F41G 1/467; F41G 1/473; F41G 3/06; F41G 3/08
USPC ..... 124/87; 33/265
See application file for complete search history.

(56) References Cited

U.S. PATENT DOCUMENTS 3,368,282 A * 2/1968 Gibson ..... F41G 1/467 33/265
4,426,787 A * 1/1984 Hayes ..... F41G 1/467 33/265
4,481,717 A * 11/1984 Kowalski ..... F41G 1/467 124/87
4,977,677 A * 12/1990 Troescher, Jr. ..... F41G 1/467 124/87
5,086,567 A * 2/1992 Tutsch ..... F41G 1/467 33/265
5,168,631 A * 12/1992 Sherman ..... F41G 1/467 33/265
5,671,724 A * 9/1997 Priebe ..... F41G 1/467 124/87
5,784,182 A * 7/1998 Francoeur ..... F41G 1/467 33/265
5,920,995 A * 7/1999 Sammut ..... F41G 1/38 42/122
6,397,483 B1 * 6/2002 Perkins ..... F41G 1/467 124/87
6,681,512 B2 * 1/2004 Sammut ..... F41G 1/38 33/265
7,036,234 B2 * 5/2006 Rager ..... F41G 1/467 124/87
7,171,775 B1 * 2/2007 Lacorte ..... F41G 1/38 42/122
7,266,896 B1 * 9/2007 White ..... F41G 1/467 124/90
7,461,460 B2 * 12/2008 Priebe ..... F41G 1/01 124/87
7,503,122 B2 * 3/2009 Afshari ..... F41G 1/467 124/87
7,578,067 B2 * 8/2009 Rager ..... F41G 1/467 124/87
7,614,156 B1 * 11/2009 Imig ..... F41G 1/467 124/87

(Continued)

*Primary Examiner* — Alexander Niconovich
(74) *Attorney, Agent, or Firm* — Merchant & Gould P.C.

(57) ABSTRACT

A sight configured to properly align a weapon in the left and right direction and in the vertical direction with respect to a target without the need to separately range the target. In particular, once the shooter aligns indicia on the site with structure on the target the weapon is properly aligned and ready firing. Knowledge of the distance between the shooter and the target is not necessary to adjust for projectile drop. Related method of use and manufacture are also provided.

18 Claims, 11 Drawing Sheets

(56) References Cited

U.S. PATENT DOCUMENTS

| | | | | |
|---|---|---|---|---|
| 7,685,760 | B1 * | 3/2010 | Neumaster | F41G 1/01 42/111 |
| 7,886,448 | B2 * | 2/2011 | Humpert | F41G 1/467 124/87 |
| 7,997,261 | B2 * | 8/2011 | Scaniffe | F41G 1/44 124/86 |
| 8,099,874 | B2 * | 1/2012 | Priebe | F41G 1/467 124/87 |
| 8,166,662 | B2 * | 5/2012 | Williams | F41G 1/467 124/87 |
| 8,316,551 | B2 * | 11/2012 | Gorsuch | F41G 1/467 124/87 |
| 8,353,454 | B2 * | 1/2013 | Sammut | F41G 1/38 235/404 |
| 8,365,423 | B2 * | 2/2013 | Humpert | F41G 1/467 124/87 |
| 8,490,611 | B2 * | 7/2013 | Maynard | F41G 1/467 124/87 |
| 8,707,608 | B2 * | 4/2014 | Sammut | F41G 1/38 42/122 |
| 8,752,303 | B2 * | 6/2014 | Priebe | F41G 1/01 124/87 |
| 9,335,120 | B2 * | 5/2016 | Roman | F41G 1/473 |
| 9,377,272 | B2 * | 6/2016 | Morrison | F41B 5/1492 |
| 9,429,393 | B2 * | 8/2016 | Graziano | F41G 1/467 |
| 9,448,037 | B1 * | 9/2016 | Murphy | F41G 1/033 |
| 2005/0229468 | A1 * | 10/2005 | Zaderey | F41G 1/38 42/122 |

* cited by examiner

WEAPON SIGHT

TECHNICAL FIELD

The present disclosure provides a sight for a projectile weapon and related methods of use and manufacture.

BACKGROUND

Sights are commonly used to align projectile type weapons with targets. Typically the orientation of the weapon in a vertical plane (e.g., elevation) is adjusted based at least in part on the distance between the shooter and the target. When a target is further from the weapon, the projectile takes longer to travel to the target due in part to the greater distance of travel and the slowing of the velocity of the projectile. This results in greater projectile drop (e.g., bullet drop, arrow drop). To account for projectile drop traditionally the shooter estimates the distance to the target and adjust the angle of the weapon accordingly. The angle of the weapon in a vertical plane relative to a horizontal reference is typically adjusted by aligning indicia in a sight that most closely corresponds to the estimated distance between the shooter and the target. Alternatively, the position of the indicia relative to the weapon is adjusted based on the estimated range to the target. However the range is accounted for, the end result is that weapon is orientated at a higher angle (raised) when the target is further away as compared to when the target is closer.

The step of ranging a target takes time and can introduce error due to the inaccuracy in estimating the range especially on a moving target. Also the step of aligning the indicia that most closely corresponds to the estimated distance or alternatively adjusting the position of the indicia based on the range can introduce additional error and take additional time. The disadvantages of traditional sighting system are most noticeable in situations where it is advantageous for the shooter to fire relatively quickly (e.g., spot and stalk hunting) and/or where the target is in motion. There is a need in the art for improved sights to take into account these real world shooting challenges.

SUMMARY

The present disclosure provides a sight that properly aligns a weapon in the left and right (windage) and in the vertical direction (elevation) without the need to separately range the target. Once the shooter visually aligns indicia on the site with structure on the target (e.g., vitals of an animal) the shooter is ready to fire as both windage and elevation have been simultaneously taken into consideration.

It should be appreciated that although the disclosed technology will be described further herein as having been integrated into an archery sight, the principles of the invention can be applied on any number of weapon site (crossbow, rife, paint ball gun, etc.).

DETAILED DESCRIPTION

Figure 1:
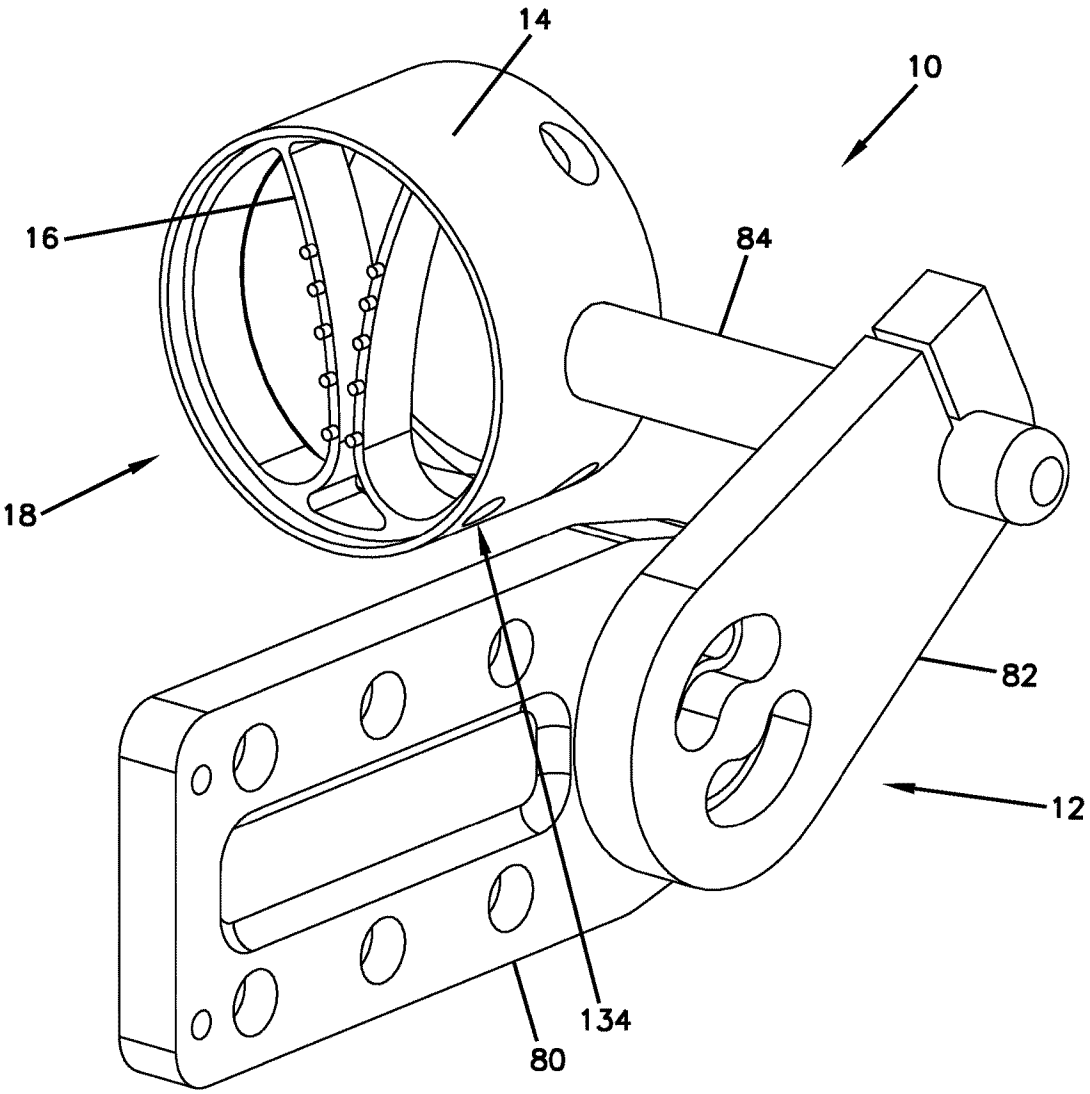
FIG. 1 is a perspective of sight according to the present disclosure.

The invention is described and shown herein as being integrated into a bow site. However, as discussed above, the technology can be integrated into a number of different weapon systems and components of weapons systems (magnified scopes for firearms, bows sights, cross-bows scopes, paintball gun sights, etc.).

Referring to FIGS. 1-4, a first embodiment of a sight according to the present disclosure is shown. In the depicted embodiment, the sight 10 includes a support arm assembly 12, protective sight body 14, and an insert 16. The support arm assembly 12 is configured to secure the protective sight body 14 to the bow and allow for precise positioning of the protective sight body 14 relative to the bow.

In the depicted embodiment, the support arm assembly 12 includes a brace 80 that bolts to the bow, a pivot arm 82 that is connected to the brace 80 configured to raises and lowers the protective sight body 14. In the depicted embodiment, the pivot arm allows for infinite adjustment in the vertical direction of the protective sight body 14 within a set range (the length of the pivot arm). A bar 84 is connected between the sight body and the pivot arm 82. The bar 84 allows for infinite left to right adjustment of the position of the sight body relative to the pivot arm within a range limited by the length of the bar 84. It should be appreciated that many alternative support arm configurations are possible.

In the depicted embodiment, the insert 16, which is configured to be removably received within the protective body 14, includes indicia thereon that are used for visually aligning the bow with the target. In the depicted embodiment, the insert 16 snaps into the sight body 14 and self-aligns with the sight body. In the depicted embodiment, the insert 16 includes boss 130, 132 (i.e., protrusions located around the exterior of the insert) that snap into locating aperture/recesses 134 in the in the sight body 14. The configuration allows the insert to be removable and replaceable. It should be appreciated that many alternative configurations of the insert are possible. For example, in some alternative embodiments the insert may be integrally formed with the protective body and configured to be directly connected to the support arm assembly.

Figure 2:
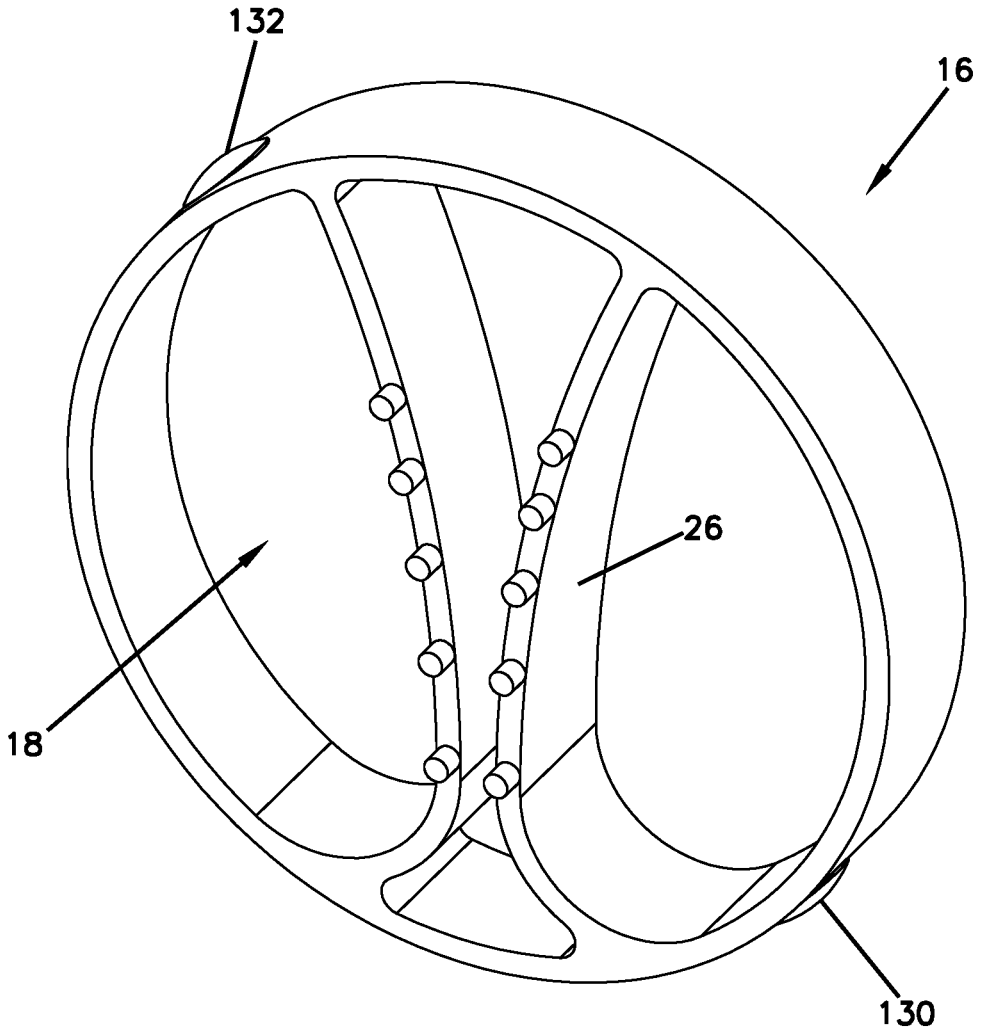
FIG. 2 is a perspective view of a component of the sight of FIG. 1.
Figure 3:
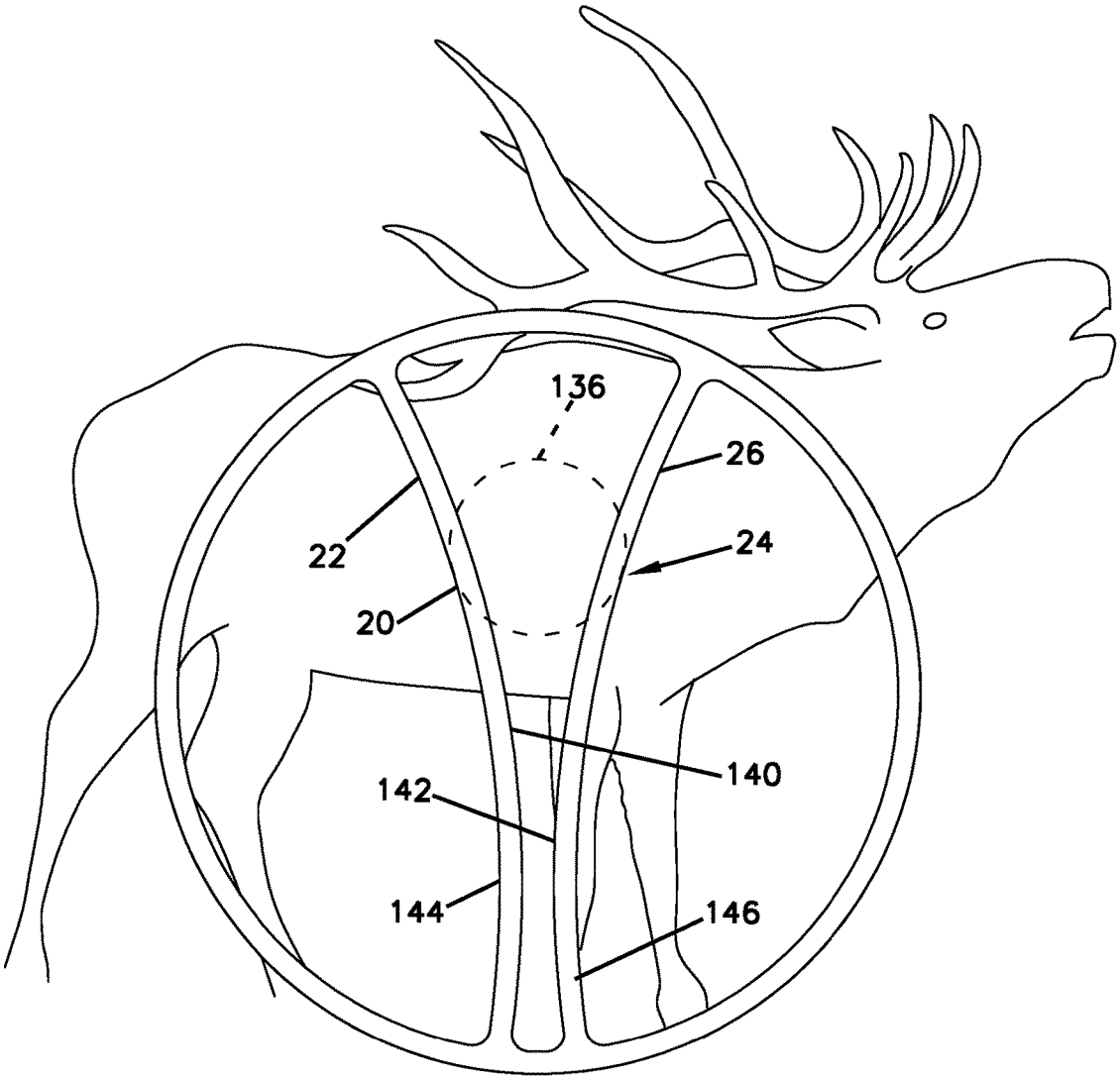
FIG. 3 is a front view of the component of FIG. 2 aligned with an elk at a first distance.
Figure 4:
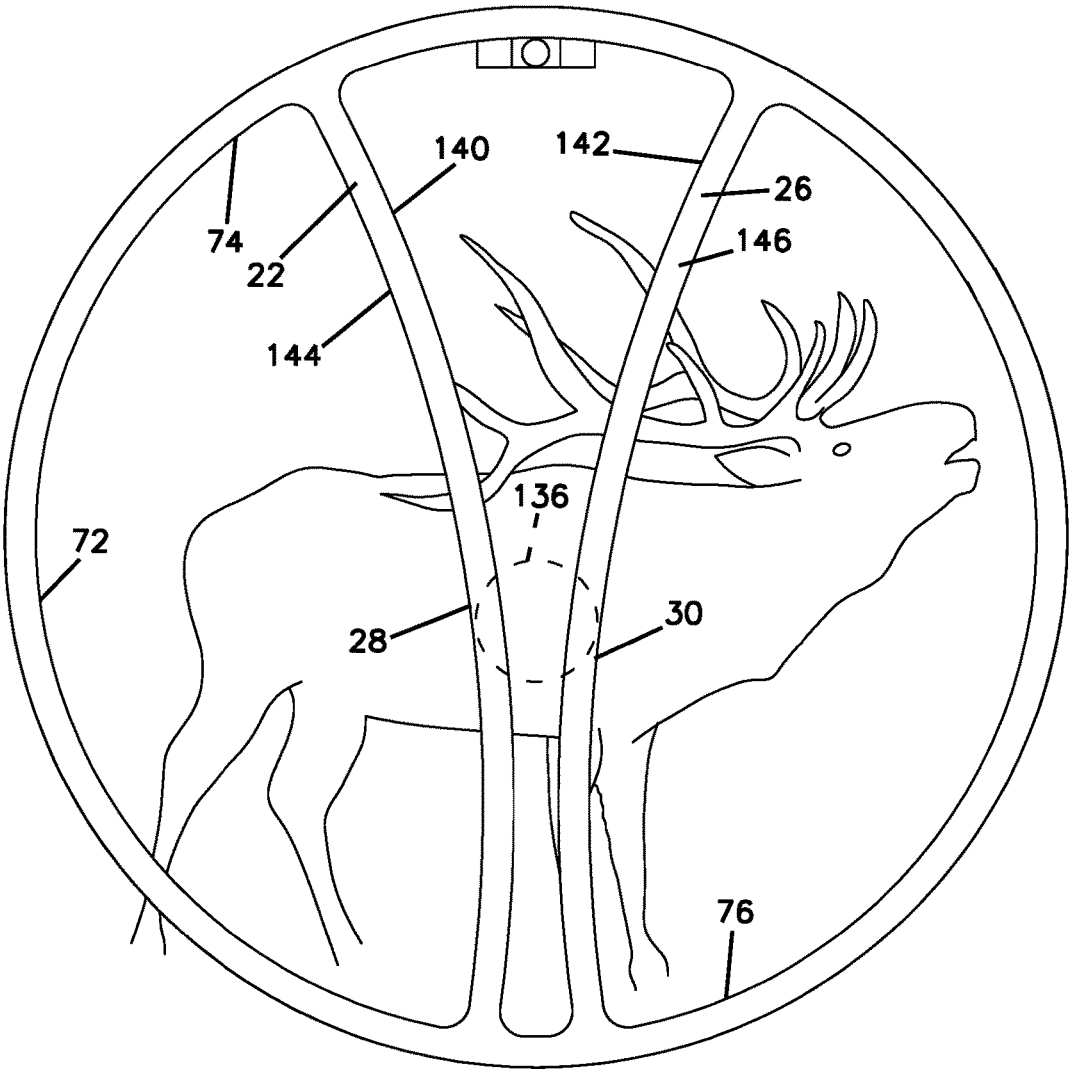
FIG. 4 is a front view of the component of FIG. 2 aligned with an elk at a second distance.

Referring generally to FIGS. 2-4, in the depicted embodiment, the insert 16 includes horizontally spaced apart indicia within a sight window 18 arranged such when horizontally opposed indicia are centered around a target (e.g., the vitals of an elk 136) of a known size (e.g., 12 inches) the sight simultaneously adjust both for windage and elevation. To align the bow with the target, the shooter raises and lowers the bow until the horizontally opposed indicia visually bracket the vitals. In the depicted embodiment, the horizontally opposed indicia include an effective portion (i.e., portions that are for sighting) that tapers downwardly forming a V-shape. Therefore, when the target is further away from the shooter the shooter raises the bow to bracket the vitals as the vitals will appear smaller to the shooter; whereas when the target is closer to the shooter the shooter lowers the bow to bracket the vitals as the vitals will appear smaller to the shooter. In the depicted embodiment, the shooter simply focuses on bracketing the vitals. As discussed above, many alternative embodiments are possible including embodiments wherein the shooter's objective is not to align indicia around the periphery of the vitals of an animal.

The above described method of use is illustrated further in FIGS. 3 and 4. In particular, FIG. 3 illustrates proper alignment of the bow relative to an elk using the sight 10 when the elk is relatively close to the shooter. FIG. 4 illustrates proper alignment of the bow relative to the elk using the sight 10 when the elk is relatively farther from the shooter. In FIG. 4, the bow is raised relative to its position in FIG. 3. As is illustrated, the sight 10 is configured such that centering the target (e.g., vitals of an elk) between the horizontally opposed indicia simultaneously adjust for both windage and elevation without any requiring further adjustment to the sight. The shooter does not need to be aware of his or hers distance to the target to make an accurate shot using the sight 10 However, as will be discussed below, the sight 10 can also be configured to provide the user information regarding his or hers range to the target.

Referring to FIG. 3, the figure depicts horizontally spaced apart indicia as being a left outer edge portion 20 of rib 22 and a right outer edge portion 24 of rib 26. The vitals are shown bracketed by the left outer edge portion 20 and right outer edge portion 24. FIG. 4 depicts horizontally spaced apart indicia as being a left outer edge portion 28 of rib 22 and a right outer edge portion 30 of rib 26. The vitals are shown bracketed by the left outer edge portion 20 and right outer edge portion 24. In the depicted embodiment, each rib 22, 26 provides at least two sets of horizontally opposed indicia at any one height. In the depicted embodiment, the gap between the inner edges 140, 142 of the ribs 22, 26 corresponds to the typical size of the vitals of a whitetail deer (e.g., 8 inches) whereas the gap between outer edges 144, 146 of the ribs correspond to the typical size of the vitals of an elk (e.g., 12 inches). It should be appreciated that many other configurations are also possible including, for example, embodiments having more or less indicia at any particular Y location that correspond to various target sizes.

Figure 5:
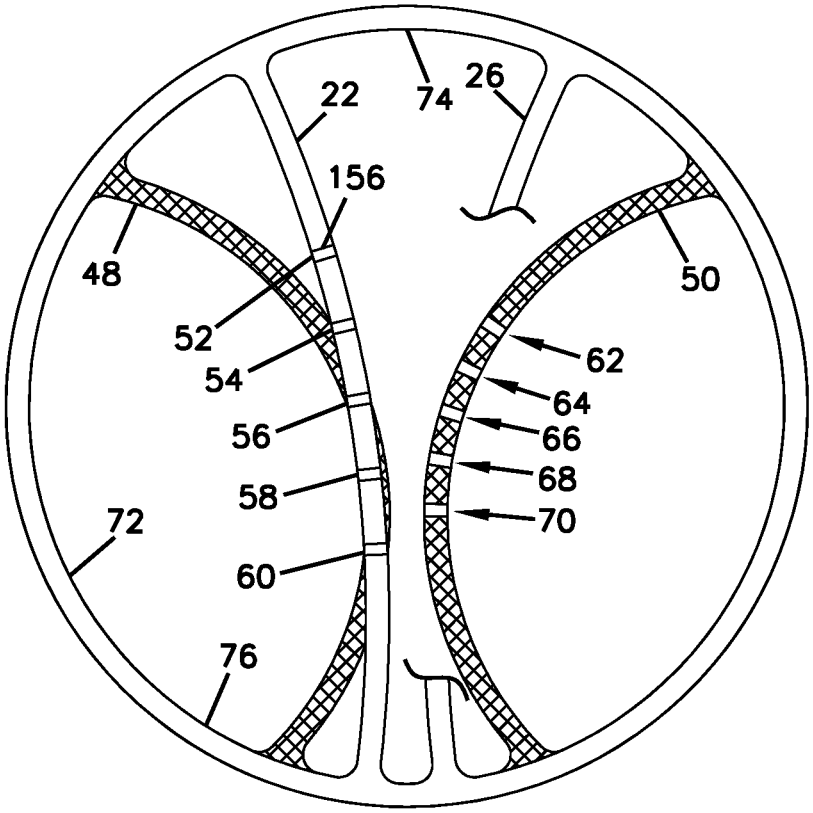
FIG. 5 is a front view of the component of FIG. 2 partially superimposed over a component configured for a weapon having a faster projectile speed.
Figure 6:
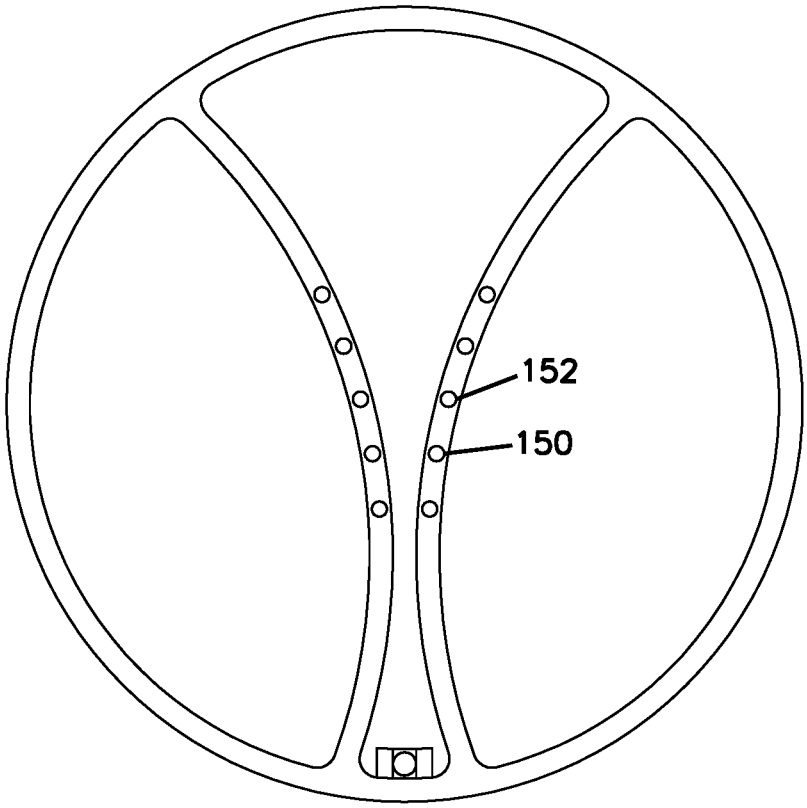
FIG. 6 is a front view of an alternative embodiment of the component of FIG. 2.
Figure 7:
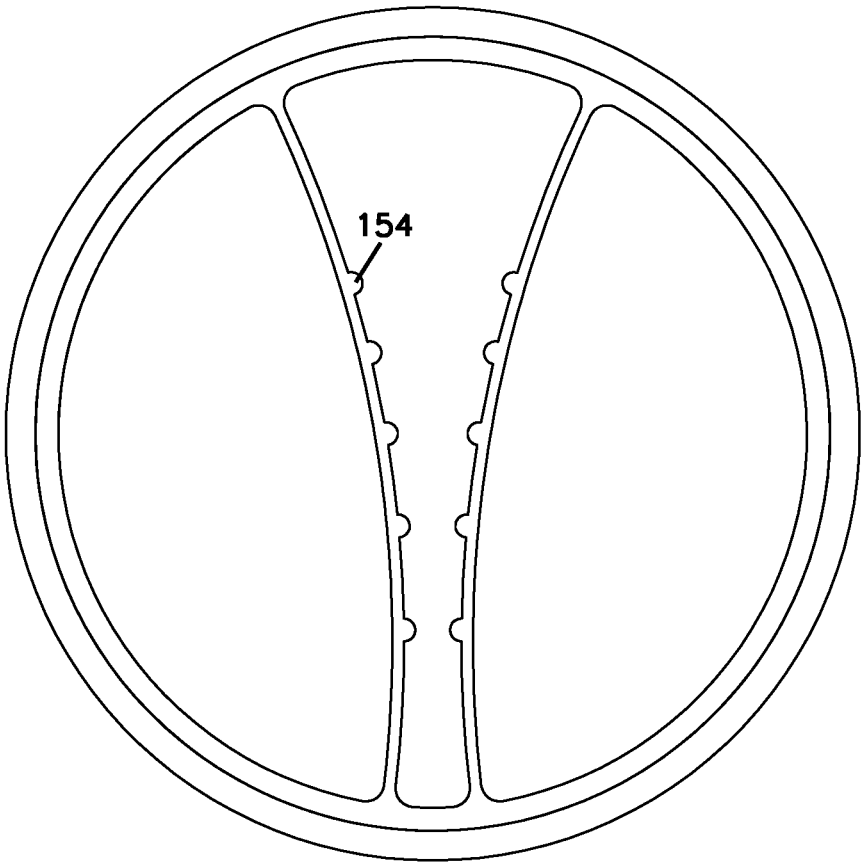
FIG. 7 is a front view of an alternative embodiment of the component of FIG. 2.

In the depicted embodiment, the ribs 22 and 26 have curved front profiles. The curvature of the ribs is dependent on the arrow speed of the bow. For bow configuration with a relatively slow arrow speeds (e.g., heavy arrows, short draw lengths, and light poundage), the curvature is mild whereas for bow setups with high arrow speeds (e.g., lighter arrows, longer draw lengths, heavy poundage), the curvature is more prominent. FIG. 5 is a front view of the ribs 22, 26 partially superimposed over a pair of ribs 48, 50 that are configured for a bow with a faster arrow speed. In the depicted embodiment, rib 22, 26 includes marks 52, 54, 56, 58, 60 that correspond to common archery yardages units (20 yards, 30 yards, 40 yards, 50 yards, and 60 yards). Rib 48, 50 includes marks 62, 64, 66, 68, 70 that correspond to the same common archery yardages units (20 yards, 30 yards, 40 yards, 50 yards, and 60 yards). These marks enable the shooter to also use the sight in accordance with the standard shooting method, which includes first ranging the target and then selecting an aiming point to align with the target based on the ranged distance. This feature can be used when the target is not of the expected size (e.g., shooting small game with the sight having ribs configured for elk and deer hunting) However, it should be appreciated that the shooter could also shoot without first ranging the target and the marks are then helpful to the shooter for estimating range (e.g., the sight 10 enables the shooter to make a quick determination of whether the shot is out of his or hers reliable shooting distance without using a separate range finder and without taking the bow out of alignment with the target). It should be appreciated that the yardage markings can take a number of forms. For example, they can be apertures 150 in the ribs (FIG. 6), they can be illuminated dots 152 (FIG. 6) (e.g., fiberoptic, iridium, LED etc.), they can be notches 154 (FIG. 7), they can be marks 156 that extend generally perpendicular to the ribs (FIG. 5), or any number of other configurations.

In the depicted embodiment, the yardage marks are more relatively compressed in the vertical direction (y-direction) on the ribs 48, 50 than they are on ribs 22, 26. The curvature of the profile of the left and right ribs is correlated to an anticipated projectile velocity associated with the sight. The distance between the indicia in the horizontal direction is correlated to the range (distance been the shooter and the target). The location of the indicia in the vertical direction is correlated to the arrow speed. It should be appreciated that the actual location of the indicia (e.g., profiles of the curves) can be determined either empirically or via known equations that correlate arrow drop with arrow speed. In some embodiment, of the present disclosure a different insert is provide for every increment in arrow speed (e.g., ever foot per second, every five feet per second, etc.).

It should be appreciated that in the depicted embodiment, the ribs 22, 26 are continuous, and therefore, provide an infinite number of horizontally spaced apart indicia. Also, in the depicted embodiment, the spaced apart ribs 22, 26 define an unobstructed viewing space therebetween. It should be appreciate that many alternative configurations are also possible. For example, in alternative embodiment, a vertical center reference may also be provided.

In the depicted embodiment, the sight window 18 includes a border 34 that is defined by a periphery body portion of the insert 16. The periphery body portion of the insert can, in some embodiments, function as a sight window frame 72. In the depicted embodiment, the sight window frame 72 including at least a top portion 74 and a bottom portion 76, wherein the first rib 22 extend from the bottom portion 76 of the sight window frame 72 to the top portion 74 of the sight window frame 72 and the second rib 26 extends from the bottom portion 76 of the sight window frame to the top portion 74 of the sight window frame 72. It should be appreciated that many alternative embodiment are possible. For example, in some alternative embodiment the sight window 32 is borderless. In such embodiments the sight window 18 can be the space that the shooter looks through to align the bow with the target (e.g., the picture defined only by the edges of a peep sight). It should be appreciated that the space that is the sight window can be open or closed (e.g., glass, clear plastic).

Figure 11:
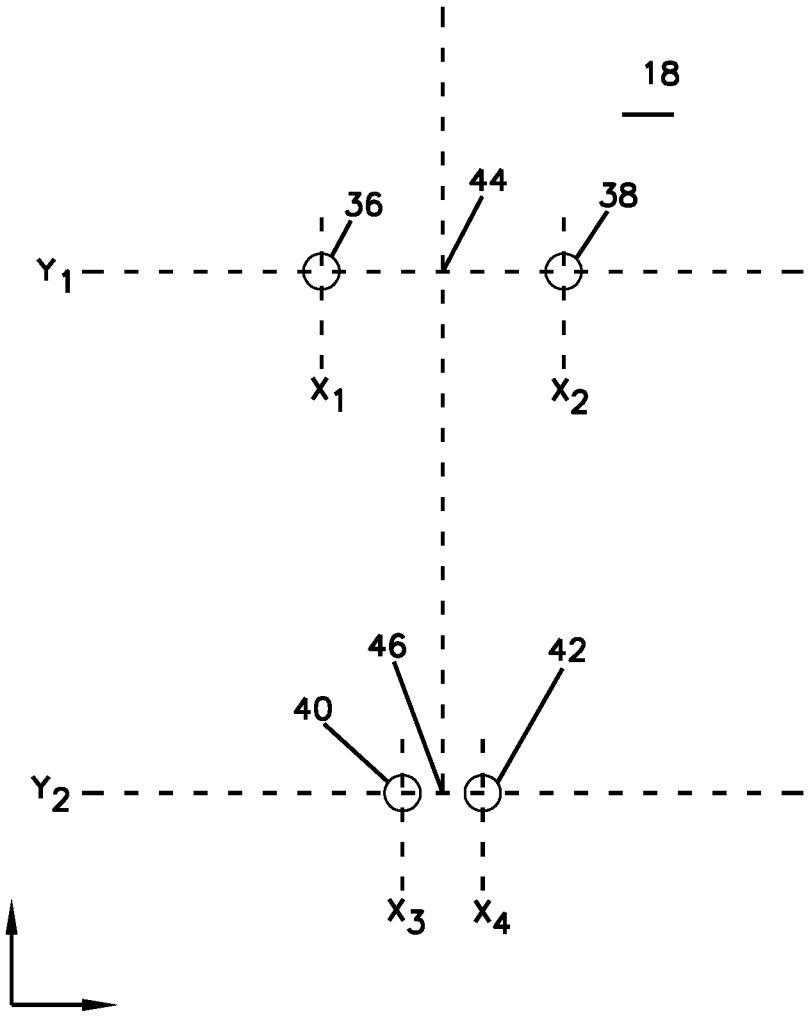
FIG. 11 is a front view of an sight window with several indicia arranged therein.

As discussed above, the horizontally spaced indicia can be provided as part of left and right ribs 22, 26. It should be appreciated that many other forms are also possible. The sight could include a few as two pairs of horizontally spaced apart indicia. Referring to FIG. 11, the sight could include a first indicia 36 located at a Y1 location and at a X1 location in the sight window; a second indicia 38 located at the Y1 location and a X2 location in the sight window; a third indicia 40 located at a Y2 location and a X3 location in the sight window; and a fourth indicia 42 located at the Y2 location and a X4 location in the sight window. As illustrated, the Y1 location is above the Y2 location and the distance between the X1 location and the X2 location is greater than the distance between the X3 location and X4 location. In addition, the midpoint 44 between the X1 location and the X2 location is vertically aligned with a midpoint 46 between the X3 location and the X4 location. As described above, the sight window is the space that the shooter look though to align the indicia with the target. It should be appreciated that the first, second, third and fourth indicia 36, 38, 40, 42 can be provided on the above described first and second ribs 22, 26. It also should be appreciated that the indicia can be provided in the sight window many other forms, some of which will be described below.

Figure 8:
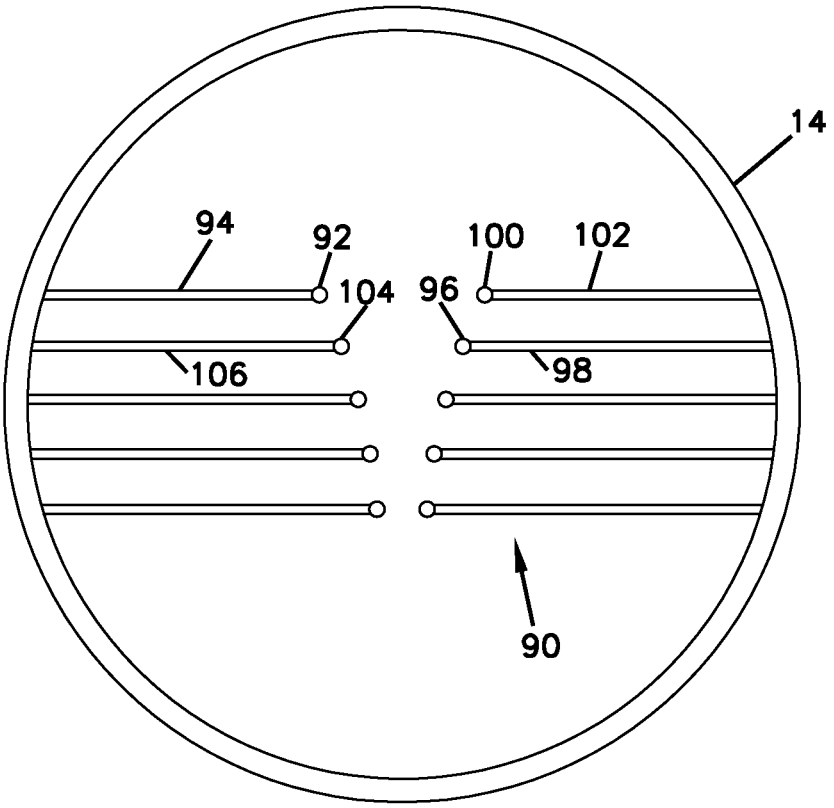
FIG. 8 is a front view of an alternative embodiment of the component of FIG. 2.

Referring to FIG. 8, the indicia are provided on the distal ends of pins. In the depicted embodiment, the pins 90 are adjustable both in vertically and/or horizontally so that the distal ends of the pins can be positioned appropriately in the sight window to match the arrow speed of the bow. In the depicted embodiment, the pins 90 are supported on the protective sight body 14. In the depicted embodiment, a first indicia 92 is provided at a distal end of a first pin 94; a second indicia 100 is provided at a distal end of a second pin 102; a third indicia 104 is provided at a distal end of a third pin 106; and fourth indicia 96 is provided on a distal end of a fourth pin 98. As discussed above, the first, second, third and fourth pins 94, 98, 102, 106 extend inwardly from a periphery portion of the sight window and are adjustable. The pins are shown horizontally oriented, but it should be appreciated that the pins could extend inwardly into the sight window from many other directions (e.g., they pins could be curved, strait with a bend, or extend for the bottom upwardly or inwardly from an angle). Many other pin related configurations are possible.

Figure 9:
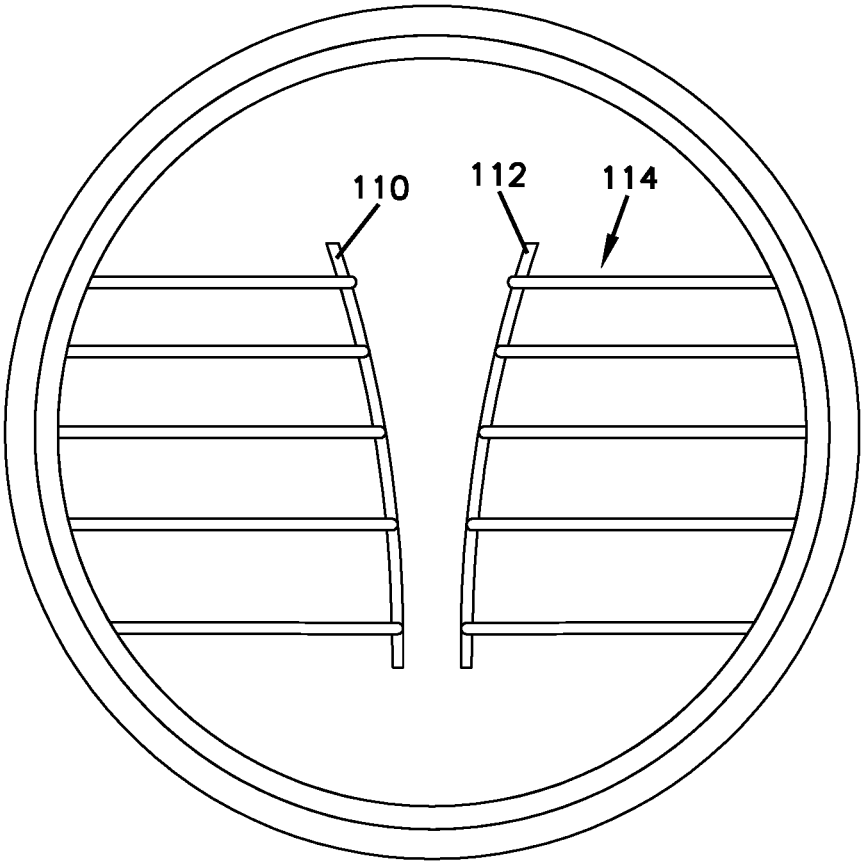
FIG. 9 is a front view of an alternative embodiment of the component of FIG. 2.

Referring to FIG. 9, the indicia could alternatively be fiber optic sections of material 110, 112 supported on a number of pins 114 or otherwise supported. In the depicted embodiment, the flexibility of the fiber material would enable it to curve as need to match the arrow speed. The profile of the curve could be adjusted by moving the distal ends of the pins in the X-Y plane. It should be appreciated that many other configurations are also possible.

Figure 10:
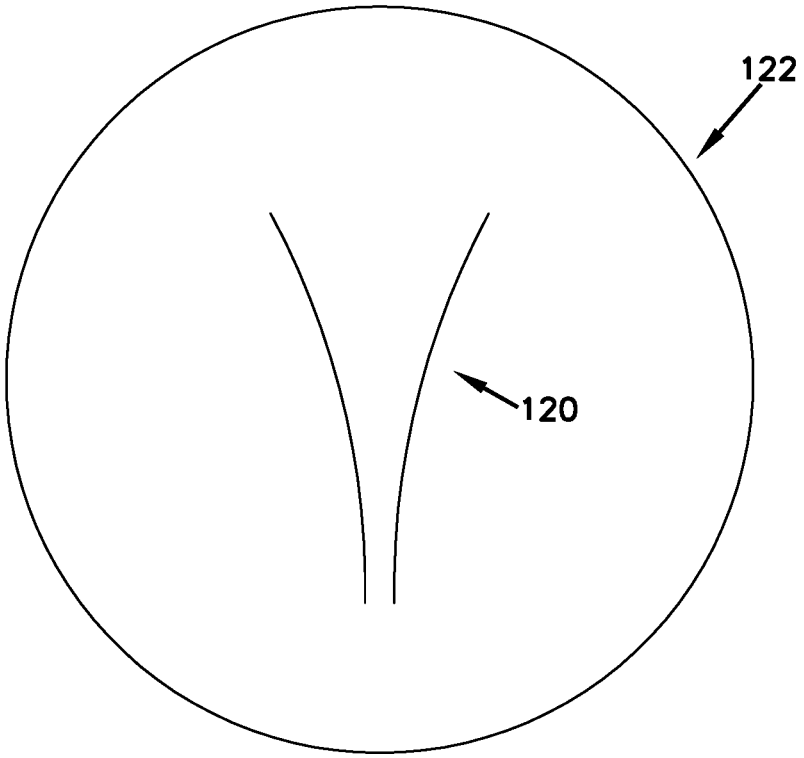
FIG. 10 is a front view of an alternative embodiment of the component of FIG. 2.

Referring to FIG. 10, an embodiment wherein the indicia are provided on a transparent material located within the sight window 18 is illustrated. In the depicted embodiment, the indicia 120 can be etched or printed onto a ridged transparent material 122. Alternatively the transparent material could be a flexible transparent material. In an embodiment wherein the transparent material is flexible, the transparent material can be a sticker with printed indicia thereon that is configured to be adhered to a ridged transparent material (tempered glass or clear plastic material) that provides support for the flexible material positioned within the sight window.

The present disclosure also provides a method of manufacturing an archery sight. The method can include the step of providing a plurality of indicia arrangements provided in a sight window that are configured to simultaneously adjust for windage and elevation, wherein each indicia arrangement corresponds to a known arrow speed. The particular indicia arrangements could, for example, be designed to correspond to arrow speeds in five feet per second increments or even specific to single feet per second increments. The method could also include the step of manufacturing a protective sight body. The protective sight body could be configured to receive removable inserts, wherein the indicia arrangements are provided on the inserts.

Various modifications and alterations of this disclosure will become apparent to those skilled in the art without departing from the scope and spirit of this disclosure, and it should be understood that the scope of this disclosure is not to be unduly limited to the illustrative examples set forth herein.

As discussed above, the present disclosure is described in the context of archery. However, the present disclosure has broader application. The term bow herein refers to an archery bow, but it should be appreciated that an archery bow is only one type of weapon system of which the disclosed technology can be adapted for use. The claims below cover sights for a variety of weapons systems. Likewise the term arrow/arrow speed refers to the speed of an arrow for archer and the speed of the arrow, however it should be appreciated that this is illustrative of any projectile and projectile speed (e.g., bullet speed, bolt speed, paint ball speed, etc.).

What is claimed is:

1. A sight comprising:

a sight window;

a first indicia located at a Y1 location and at a X1 location in the sight window;

a second indicia located at the Y1 location and a X2 location in the sight window;

a third indicia located at a Y2 location and a X3 location in the sight window;

a fourth indicia located at the Y2 location and a X4 location in the sight window;

a fifth indicia located on a first curved path defined between the first indicia and the third indicia;

a sixth indicia located on a second curved path defined between the second indicia and the fourth indicia;

wherein the Y1 location is above the Y2 location and the distance between the X1 location and the X2 location is greater than the distance between the X3 location and X4 location;

wherein a midpoint between the X1 location and the X2 location is vertically aligned with a midpoint between the X3 location and the X4 location;

wherein the curvature of the first and second curved paths are correlated to an expected projectile speed and wherein each of the indicia are provided on a first rib and a second rib, wherein the first and second ribs are opposed and curve away from each other, wherein lower end portions of the first and second ribs are closer together than upper end portions of the first and second ribs.

2. The sight of claim 1, wherein the first indicia, third indicia and fifth indicia are provided on the first rib; and wherein the second indicia, fourth indicia and sixth indicia are provided on the second rib.

3. The sight of claim 1, wherein the first and second ribs are the only structures provided in the sight window.

4. The sight of claim 1, further comprising a sight window frame position around at least a portion of a periphery of the sight window, the sight window frame including at least a top portion and a bottom portion, wherein the first rib extends from the bottom portion of the sight window frame to the top portion of the sight window frame and the second rib extends from the bottom portion of the sight window frame to the top portion of the sight window frame.

5. The sight of claim 4, further comprising a protective sight body, wherein the sight window frame is configured to be removable received within the protective sight body.

6. The sight of claim 1, wherein the first indicia is provided at a distal end of a first pin and second indicia are provided on a distal end of a second pin; and wherein the third indicia is provided at a distal end of a third pin and fourth indicia is provided at a distal end of a fourth pin.

7. The sight of claim 6, wherein the first, second, third and fourth pins extend inwardly from a periphery portion of the sight window and are adjustable.

8. The sight of claim 1, wherein the first, second, third and fourth indicia are provided on a transparent material located within the sight window.

9. The sight of claim 8, wherein the first, second, third and fourth indicia are etched in a rigid transparent material.

10. The sight of claim 8, wherein the first, second, third and fourth indicia are printed on a flexible transparent material.

11. A sight comprising:

horizontally spaced apart indicia within a sight window arranged such when horizontally opposed indicia are centered around a target of a known size the sight simultaneously adjust both for windage as well as the distance between the target and the sight wherein the horizontally opposed indicia are provided on two spaced apart ribs and wherein each rib has a continuous curve in a direction away from each other.

12. The sight of claim 11, further comprising a protective sight body that is configured to receive an insert, wherein the insert includes the horizontally spaced indicia and is removable secured within the protective sight body.

13. The sight of claim 12, wherein the sight window includes a border that is defined by a periphery body portion of the insert.

14. The sight of claim 11, wherein there are at least two sets of horizontally opposed indicia each set corresponding to a different size target.

15. The sight of claim 14, wherein the spaced apart ribs define an unobstructed viewing space therebetween.

16. The sight of claim 11, wherein the sight window is borderless.

17. The sight of claim 11, wherein the sight is configured such that centering of an elk between the horizontally opposed indicia simultaneously adjust for both windage and elevation without any requiring further adjustment to the sight.

18. A method manufacturing an archery sight comprising:

providing a plurality of indicia arrangements provided on a pair of oppositely curved ribs in a sight window that are configured to simultaneously adjust for windage and elevation, wherein each indicia arrangement corresponds to a known arrow speed;

wherein the sight includes a protective sight body and removable inserts, wherein the indicia arrangements are provided on the inserts.

* * * * *